United States Patent [19]

Gussefeld

[11] 4,053,141

[45] Oct. 11, 1977

[54] STATIC MIXER FOR FLOWING MEDIA

[75] Inventor: Horst Gussefeld, Uttenreuth, Germany

[73] Assignee: Siemens Aktiengesellschaft, Berlin and Munich, Germany

[21] Appl. No.: 596,838

[22] Filed: July 17, 1975

[30] Foreign Application Priority Data

Aug. 2, 1974 Germany ..... 2437359

[51] Int. Cl.[2] ..... B01F 5/24

[52] U.S. Cl. ..... 366/339

[58] Field of Search ..... 259/4 R, 4 A, 4 AB, 259/4 AC

[56] References Cited

U.S. PATENT DOCUMENTS

| | | | |
|---|---|---|---|
| 1,626,487 | 4/1927 | Warren | 259/4 AB |
| 3,223,388 | 12/1965 | Knox | 259/4 R |
| 3,367,635 | 2/1968 | Gresch | 259/4 R |

FOREIGN PATENT DOCUMENTS

| | | |
|---|---|---|
| 42,206 | 5/1910 | Austria |

*Primary Examiner*—Richard E. Aegerter
*Assistant Examiner*—Willis Little
*Attorney, Agent, or Firm*—Kenyon & Kenyon, Reilly, Carr & Chapin

[57] ABSTRACT

A static mixer for flowing media is disclosed. More specifically, the mixer comprises a tubular enclosure and guide surfaces which are in the form of multiple-thread screw surfaces which are alternatingly interrupted, overlap each other and extend to and are concentric with the tubular enclosure. A mixer designed in this manner provides a thorough mixing of the flowing media within a short length of the enclosure. Moreover, with the present mixer, little pressure loss occurs and the flowing media is distributed uniformly over the exit cross section.

5 Claims, 5 Drawing Figures

STATIC MIXER FOR FLOWING MEDIA

BACKGROUND OF THE INVENTION

1. Field of the Invention

This invention relates to a static mixer for flowing media and, in particular, to a static mixer having a tubular enclosure which encloses guide surfaces.

2. Description of the Prior Art

A static mixer is defined as a mixer without moving parts. The media to be mixed (gases, liquids or pastes of low viscosity) are driven in the same direction, for instance, by means of blowers, pumps or presses through tubular enclosures which contain inserts with guide surfaces for mixing the media. The maintenance of these mixers is essentially confined to the disassembly and reassembly of the mixer components for cleaning, which is easily done. Also, the operating and manufacturing costs are low and the possibilities for installation in plants for chemical processes are many. Static mixers can be used, for instance, for the preparation of suspensions or emulsions, and in the plastics industry, for the admixing of hardeners, pigments and other additives to liquid synthetic resins or for the mixing of polymers and copolymers.

In one known type of static mixer inserts which comprise several guide surfaces are employed. These surfaces divide the flowing media into layers and combine the substreams flowing in the layers to form a new overall stream so that originally adjacent substreams come to lie at a distance from each other. A multiplicity of such inserts is placed in tandem in such a manner that the layer formation caused by the succeeding insert is perpendicular to the layer formation generated at the preceding insert.

In another known type of static mixer, the inserts employed comprise several alternatingly left-handed and right-handed helices, each rotated by 180°, which are arranged coaxially with the tubular enclosure and whose intersecting surfaces are perpendicular to each other. The mixing action in this type of mixer is brought about by the division of the flowing media at the one end of each helix into two substreams which are rotated by 180° as they pass through the helix and are brought together again at the other end. At the next helix, the just combined stream is again divided into two substreams perpendicular to the previous intersecting surfaces.

The operation of the previously described known static mixers is, therefore, based on the repeated division at each helix of the flowing media into substreams and the subsequent recombination of these substreams. By lining up may helices, one obtains good mixing, but at the expense of an overall structural length for the mixer which is disadvantageously quite large.

It is therefore an object of the present invention to realize a static mixer having guide surfaces arranged to achieve good mixing action in a length of enclosure which is reasonably short.

SUMMARY OF THE INVENTION

In accordance with the principles of the present invention, the above and other objectives are realized by a mixer comprising a tubular enclosure and guide surfaces which are in the form of multiple-screw thread or helical surfaces which are alternatingly interrupted, overlap each other and are concentric with the axis of and extend up to the inner wall of the tubular enclosure.

The guide surfaces thus comprise helical portions or turns which turn around the central axis of the tubular enclosure, and have the same sense of rotation wherein substreams flowing in adjacent turns can temporarily combine at the interruptions of the guide surfaces. Moreover, the guide surfaces overlap in such a manner that guide surface turns situated immediately behind each other in the direction of the axis of the tubular enclosure are interrupted at different respective points so as to block a direct flow path parallel to the axis of the tubular enclosure and thereby force the substreams into helical paths. An interruption in a guide surface is, therefore, always followed in the axial direction by a helical portion or turn of the next guide surface lying behind it.

At the interruptions of the guide surfaces a repeated division and combination of the substreams takes place. The particular effectiveness of the mixing is caused by the fact that at the interruptions, part of a substream is always deflected into a turn further back in the flow direction, and continuous recycling thus takes place.

Advantageously, the number of helical or screw thread surfaces used to form the guide surfaces may be made to correspond to the number of the media or components to be mixed. Moreover, the guide surfaces are, preferably, attached to a member whose axis is coaxial to the central axis of the tubular enclosure, e.g., a cylinder. It is particularly advantageous to design the member with the guide surfaces attached as a removable insert. Such an insert is inexpensive to fabricate and can easily be installed, disassembled and cleaned.

The mixer according to the invention can also be used in pipe lines for conveying media between pipes of different cross section. When used in this way, the transition from the cross section of a feed pipe carrying the media to be mixed to the larger cross section of a component which is to receive the mixed media is advantageously accomplished by designing the tubular enclosure of the mixer to be flared out or tapered in the flow direction in funnel-fashion.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 2:
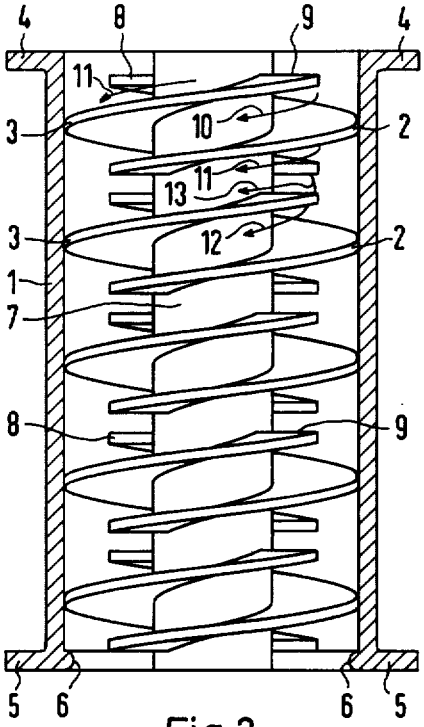
FIGS. 1 and 2 show, schematically, two side views of a first embodiment of a mixer according to the invention.
Figure 1:
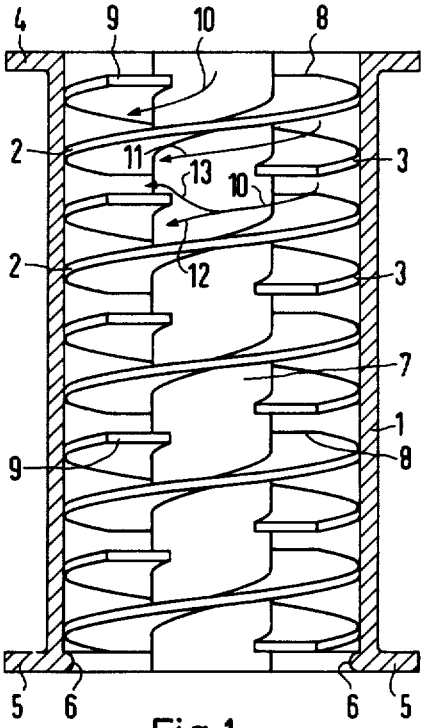
Figure 3:
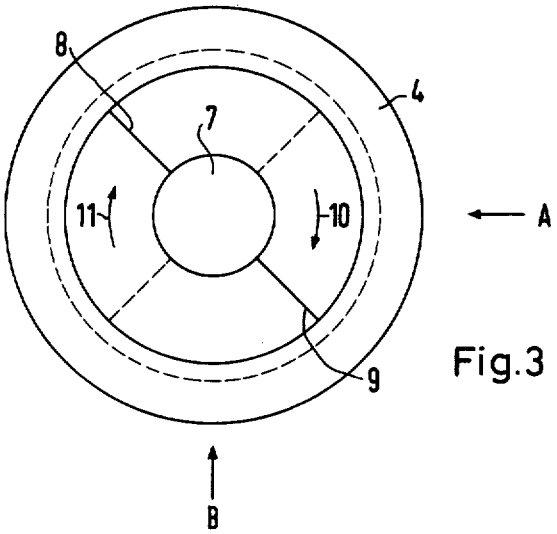
FIG. 3 shows a top view of the mixer of FIGS. 1 and 2.

As shown in FIGS. 1 to 3 the mixer of the present invention comprises a tubular enclosure or housing 1, which encloses two guide surfaces 2 and 3 which are in the form of double-thread, interrupted screw surfaces. The tubular enclosure 1 is provided at its respective ends with flanges 4 and 5, respectively. At the flange 5, adjacent the outlet side of the mixer, the inside wall of the tubular enclosure has a circular bead 6, on which the insert formed by the guide surfaces 2 and 3 and the mounting 7 supporting such surfaces rests. The leading edges 8 and 9 of the two guide surfaces 2 and 3 adjacent the inlet of the mixer, divide the inflowing media into two substreams 10 and 11.

As can be observed, each of the guide surfaces 2 and 3 is formed so as to undergo consecutive helical turns of 270° which are interrupted or separated by helical turns of 90°. Thus, the guide surface 2, which starts at the edge 8, would form, if made without interruptions, a continuous screw or helical surface, and likewise the surface 3, which starts at the edge 9, a second continuous screw of helical surface. In FIG. 1, the interruptions of the surface 2 are largely covered up by the cylindrical mounting 7, making the surface appear as nearly continuous, while the interruptions of the surface 3 are fully visible. In FIG. 2, the alternating overlap of the guide surfaces 2 and 3 can be seen by observing, at the right in the figure, that the interruptions of the surface 3 are followed by continuous portions of the surface 2, and by observing, at left in the figure, that the interruptions of the surface 2 are followed by continuous portions of the surface 3.

FIG. 3 shows a top view of the mixer of FIGS. 1 and 2. The arrows A and B in FIG. 3 indicate the viewing directions corresponding to the aforesaid two figures.

The operation of the mixer of FIGS. 1 to 3 will now be described. More particularly, the inflowing media, divided into two substreams 10 and 11, combine, for instance, at an interruption of the screw surface 3 which separates them. After the interruption, a portion 13 of the substream 10 is thus found to have coupled into the higher turn or path, through which the substream 11 flows. As a result, this portion of substream 10 must revolve or circulate around the central axis of the enclosure on its path to the outlet by a half a revolution more than the undeflected part 12 of the substream 10. This recycling, which may at first seem insignificant, results in a surprisingly complete mixing of the substreams 10 and 11 after only a few revolutions.

To test the mixing action of the present mixer, a mixer according to the embodiment of FIGS. 1 and 3 was constructed. The latter mixer comprised a tubular enclosure having an inside diameter of 50 mm and a cylindrical mounting having a diameter of 20 mm. The guide surfaces on the mounting were each 3 mm thick and had a pitch of 20 mm. Each surface, moreover, had five helical turns, so that the length of the mixer was 100 mm. In operation, the mixer was fed with water and an aqueous crystal purple solution. When examined at the outlet, a solution having a homogeneous coloring without striation or other inhomogeneities resulted. For comparison, a commercially available mixer containing inserts comprising helices and having the same diameter tubular enclosure and twice the structural length of the aforesaid constructed mixer was used. The mixing action obtained with this commercial mixer, however, was not as good as that obtained with the constructed mixer.

It should be pointed out that the present mixer can be designed to accomodate higher viscosity media by increasing the pitch of the screw surfaces. Moreover, when sending pastes of low viscosity through the present mixer, the danger of clogging (self locking) can be minimized by also selecting a larger pitch for the screw surfaces.

Figure 4:
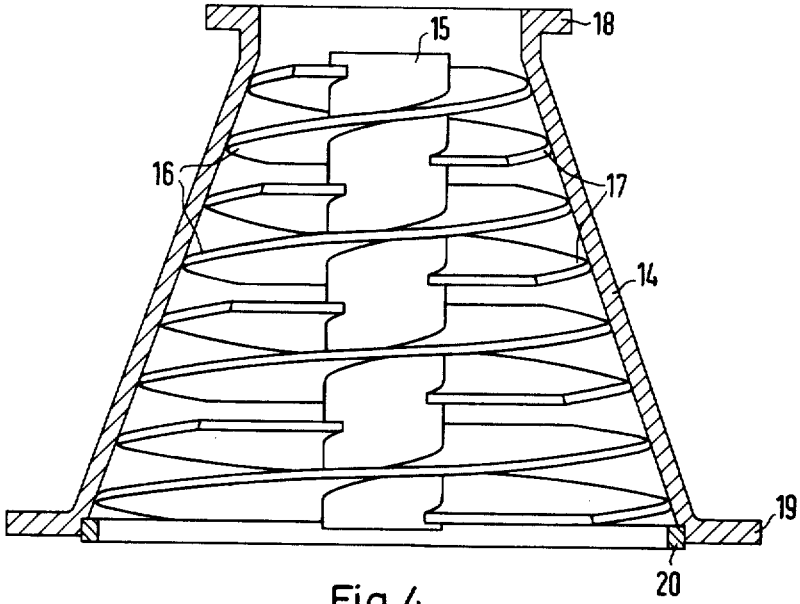
FIGS. 4 and 5 show, schematically, two side views of a second embodiment of a mixer according to the invention.
Figure 5:
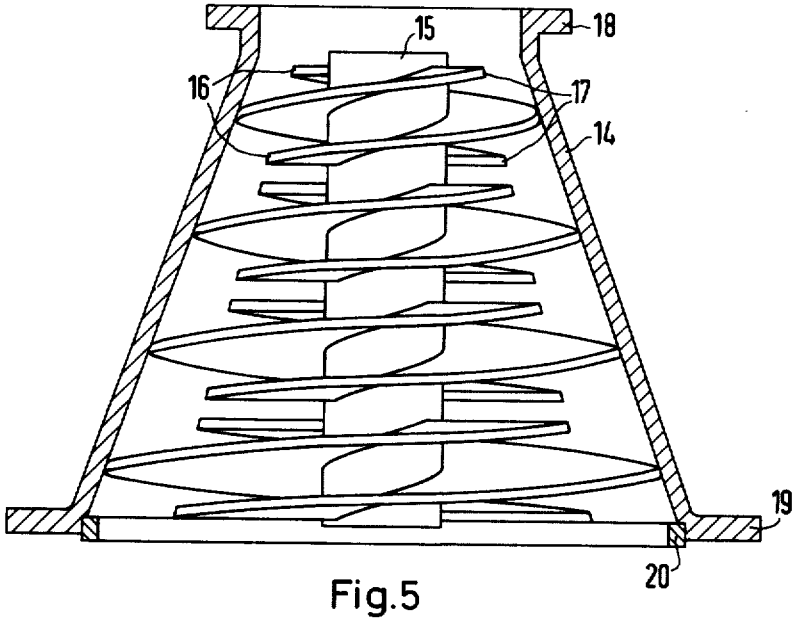

FIGS. 4 and 5 show respective side views of a second embodiment of a mixer according to the invention. As shown, the mixer includes a conical enclosure 14 and guide surfaces 16 and 17 which are fastened to a cylindrical mounting 15. The enclosure 14 has a flange 18 at the mixer inlet opening and a flange 19 at the mixer outlet opening. The insert formed by the mounting 15 and the guide surfaces 16 and 17 rests on a snap ring 20 arranged at the outlet opening. The guide surfaces 16 and 17 are in the form double-thread screw surfaces with constant pitch but an increasing diameter which follows the taper of enclosure 14.

The mixer of FIGS. 4 and 5 with its tapered in funnel-fashion enclosure, can be used advantageously, for instance, as a reaction chamber for liquids or gases which when reacted with each other are accompanied by a change in volume. In particular, use of the present mixture for such a purpose permits the reacting element to be thoroughly mixed. Secondly, it also permits a desired flow velocity to be maintained due to the changing flow cross section. Finally, due to the good convective heat transfer within the enclosure wall, it permits the reaction temperature to be maintained from the outside.

Additionally, the mixer of FIGS. 4 and 5 can also be used advantageously to mix gases which flow from a small feeder tube and, when mixed, are to be fed to a cylindrical chamber of larger cross section, filled with a catalyst.

More specifically according to the calculations by Hagen and Poiseuille, the velocity of a medium flowing in a pipe drops rapidly in the vicinity of the wall of the pipe. In the pipe lines of chemical plants, the flow of the flowing media is, therefore, heavily concentrated about the central axis of the pipes. As a result, if a mixture of reactive media is to be fed to a catalytic chamber in such a manner that the catalyst is loaded uniformly, the stream of the media must be enlarged so that it corresponds to the input cross section of the chamber and is, thus, distributed uniformly.

An example of an application in which the above enlargement must be made is the catalytic conversion of gaseous fuels, e.g., evaporated lead-free gasoline of low octane number, and oxygen-containing gases, e.g., air or exhaust gas, to form fuel gas (reformed or cracked gas). Generators for generating such gas are described, for instance, in U.S. Pat. No. 3,828,736 and the U.S. Application Ser. No. 440,023. If the mixer of FIGS. 4 and 5 is used with such a generator, the gases to be converted are conducted to the inlet opening of the mixer, are thoroughly mixed in a short distance and distributed uniformly over the entire outlet cross section, which is at the same time the inlet cross section of the generator chamber.

Because of the compact design and the inexpensive manufacture, the present mixer is well suited for use with reformed-gas generators of a type having application in internal-combustion engines of motor vehicles. In addition, when used in such a generator, the gas mixture can be preheated effectively in the mixer, if the mixer enclosure is arranged in a heat exchange relationship with the exhaust gases of the internal-combustion engine.

The pressure loss that occurs in a mixer according to the present invention was measured by constructing a mixer having a configuration in accordance with the embodiment of FIGS. 4 and 5. The constructed mixer comprised a tubular enclosure having a length of 100 mm and an inside diameter which increased in the direction of flow from 32 mm to 100 mm. The cylindrical mounting of the mixer had a diameter of 20 mm and the guide surfaces had a constant pitch of 20 mm with a thickness of 3 mm. With a throughput of 17.4 $Nm^3$ of air per hour, a pressure loss of 40 mm water column occurred. The mixer according to the invention is, therefore, superior to the known mixing devices as a result of its simple design, low cost, low pressure loss and small dimensions. Moreover, in its funnel-shaped embodiment, it is versatile in its application.

What is claimed is:

1. A static mixer for use with flowing media comprising:

a tubular enclosure; and a number of guide surfaces arranged within said enclosure, said guide surfaces being in the form of multiple-thread screw surfaces which overlap each other, have the same sense of rotation, and are concentric with the axis of and extend up to said enclosure, said multiple-thread screw surfaces also being alternatingly interrupted so that an interruption in each one of said surfaces is followed in the axial direction by an uninterrupted portion of another of said surfaces, whereby mixing takes place through recycling the media being mixed while direct flow through said mixer is prevented.

2. A static mixer according to claim 1 in which the number of screw-thread surfaces corresponds to the number of components to be mixed.

3. A mixer according to claim 1 further including:

a cylindrical mounting disposed within said housing, said mounting being arranged coaxially with the axis of said enclosure and having attached thereto said guide surfaces.

4. A mixer in accordance with claim 3 in which said mounting is removably insertable in said enclosure.

5. A mixer in accordance with claim 1 in which said enclosure is tapered in the direction in which said media is to flow.

* * * * *